US011666091B2

(12) United States Patent
Liu

(10) Patent No.: US 11,666,091 B2
(45) Date of Patent: Jun. 6, 2023

(54) ELECTRONIC CIGARETTE HAVING INDICATION LIGHT

(71) Applicant: Tuanfang Liu, Shenzhen (CN)

(72) Inventor: Tuanfang Liu, Shenzhen (CN)

( * ) Notice: Subject to any disclaimer, the term of this patent is extended or adjusted under 35 U.S.C. 154(b) by 329 days.

(21) Appl. No.: 16/930,339

(22) Filed: Jul. 16, 2020

(65) Prior Publication Data

US 2022/0015419 A1 Jan. 20, 2022

(51) Int. Cl.

| | |
|---|---|
| ***A24F 13/00*** | (2006.01) |
| ***A24F 40/40*** | (2020.01) |
| ***H05B 45/20*** | (2020.01) |
| ***A24F 40/95*** | (2020.01) |

(52) U.S. Cl.
CPC ..... *A24F 40/40* (2020.01); *A24F 40/95* (2020.01); *H05B 45/20* (2020.01)

(58) Field of Classification Search
CPC ..... A24F 47/00
USPC ..... 131/328–329
See application file for complete search history.

(56) References Cited

U.S. PATENT DOCUMENTS

2020/0214360 A1* 7/2020 Nguyen ..... A24F 40/40
2022/0046997 A1* 2/2022 Atkins ..... A24F 40/90

* cited by examiner

*Primary Examiner* — Phuong K Dinh
(74) *Attorney, Agent, or Firm* — Matthias Scholl P.C.; Matthias Scholl

(57) ABSTRACT

An electronic cigarette including an atomization assembly and a battery assembly. The atomization assembly is disposed on the battery assembly. The battery assembly includes a battery indicating circuit module. The battery indicating circuit module includes a LED light and a control panel. The control panel includes a battery indicating circuit configured to control the LED light to display a color to indicate a battery level of the battery assembly.

8 Claims, 5 Drawing Sheets

ELECTRONIC CIGARETTE HAVING INDICATION LIGHT

BACKGROUND

The disclosure relates to an electronic cigarette comprising a battery indicating circuit module.

Known electronic cigarettes comprise no battery indicator.

SUMMARY

The disclosure provides an electronic cigarette comprising an atomization assembly and a battery assembly. The atomization assembly is disposed on the battery assembly. The battery assembly comprises a battery indicating circuit module.

The battery indicating circuit module comprises a LED light and a control panel. The control panel comprises a battery indicating circuit configured to control the LED light to display a color to indicate a battery level of the battery assembly.

The color of the LED light is controlled by the control panel; when the battery is fully charged, the LED light turns green; when the battery is half charged, the LED light turns blue; when the battery is out of power, the LED light turns red.

The battery indicating circuit module further comprises a lampshell and a battery; the battery comprises an output end connected to an input end of the control panel to supply power to the control panel; the lampshell is disposed outside the LED light.

The lampshell comprises polycarbonate.

The atomization assembly is disposed on the battery assembly; and the atomization assembly comprises a magnet and the battery assembly comprises a stainless iron adsorbing on the magnet.

DETAILED DESCRIPTION

To further illustrate, embodiments detailing an electronic cigarette are described below. It should be noted that the following embodiments are intended to describe and not to limit the disclosure.

Figure 1:
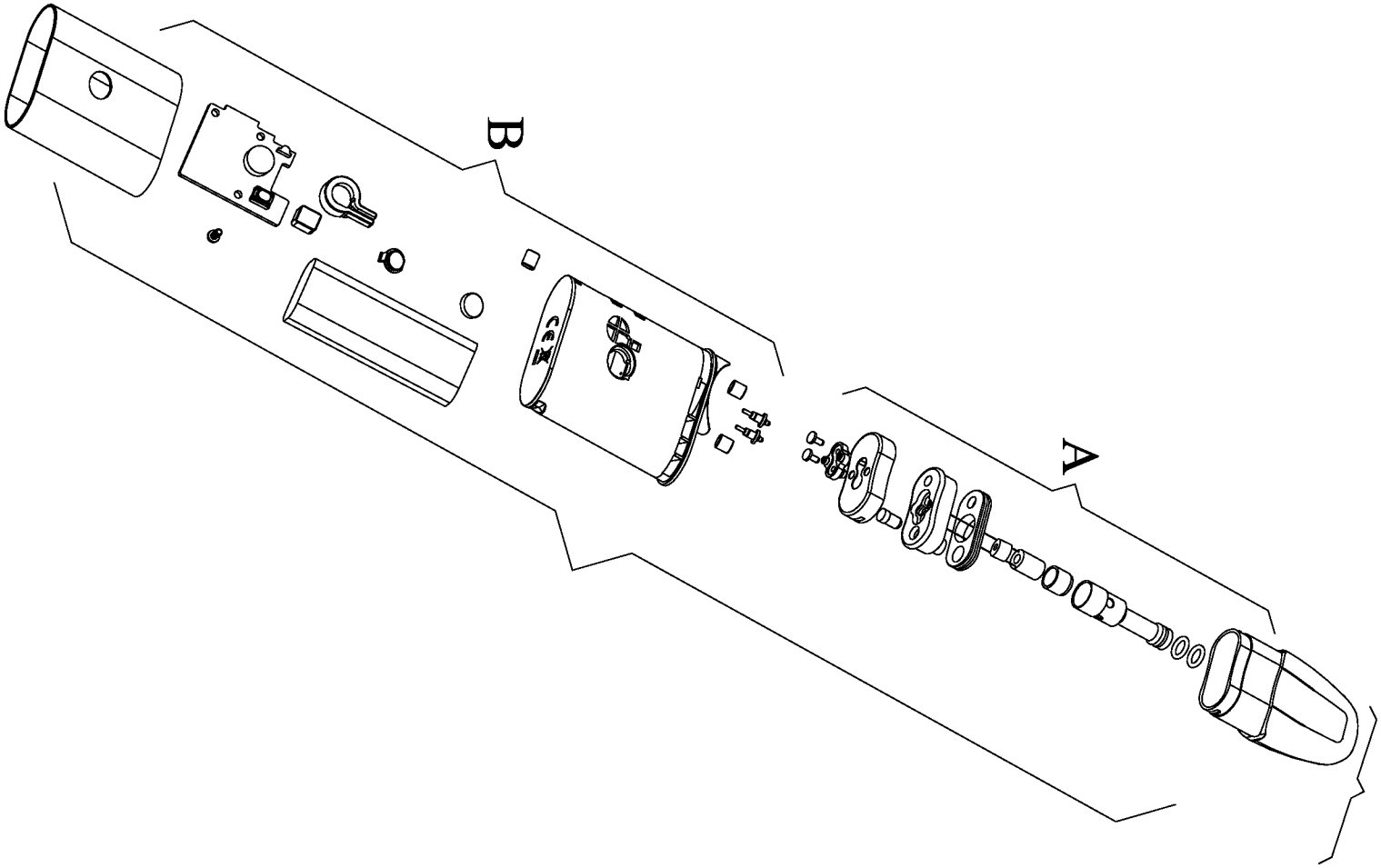
FIG. 1 is an exploded view of an electronic cigarette according to one embodiment of the disclosure.
Figure 2:
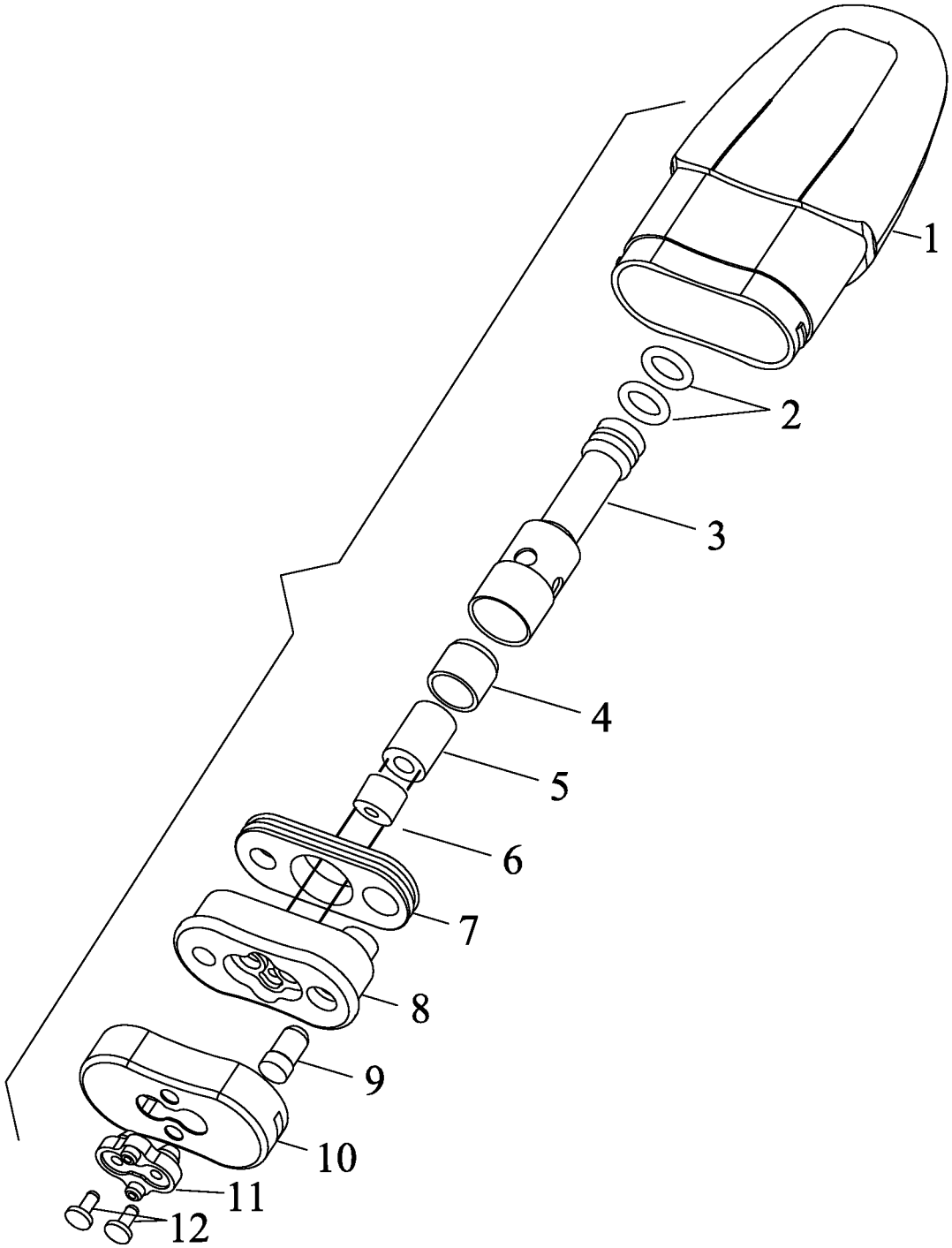
FIG. 2 is an exploded view of an atomization assembly of an electronic cigarette in FIG. 1.
Figure 3:
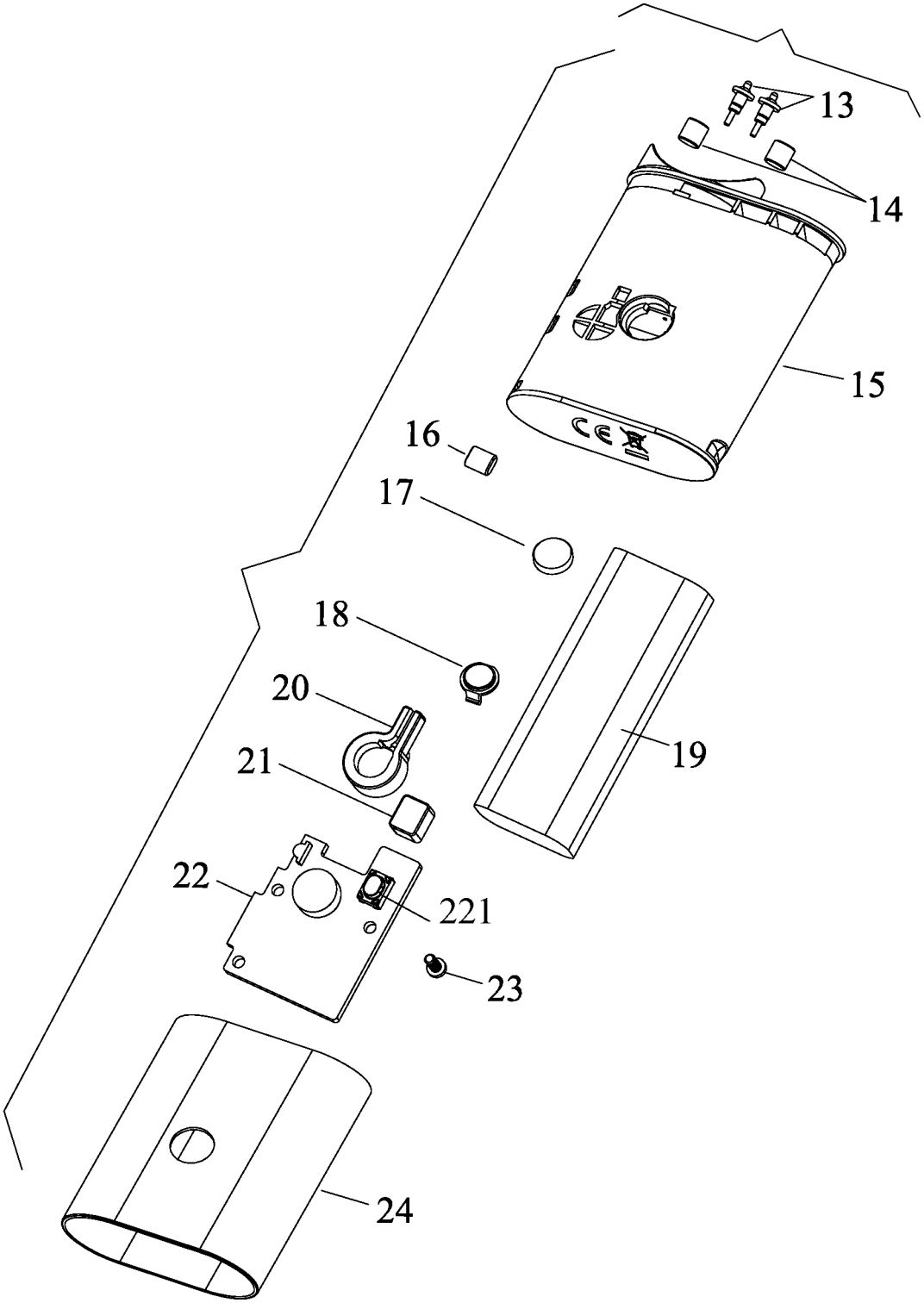
FIG. 3 is an exploded view of a battery assembly of an electronic cigarette in FIG. 1.
Figure 4:
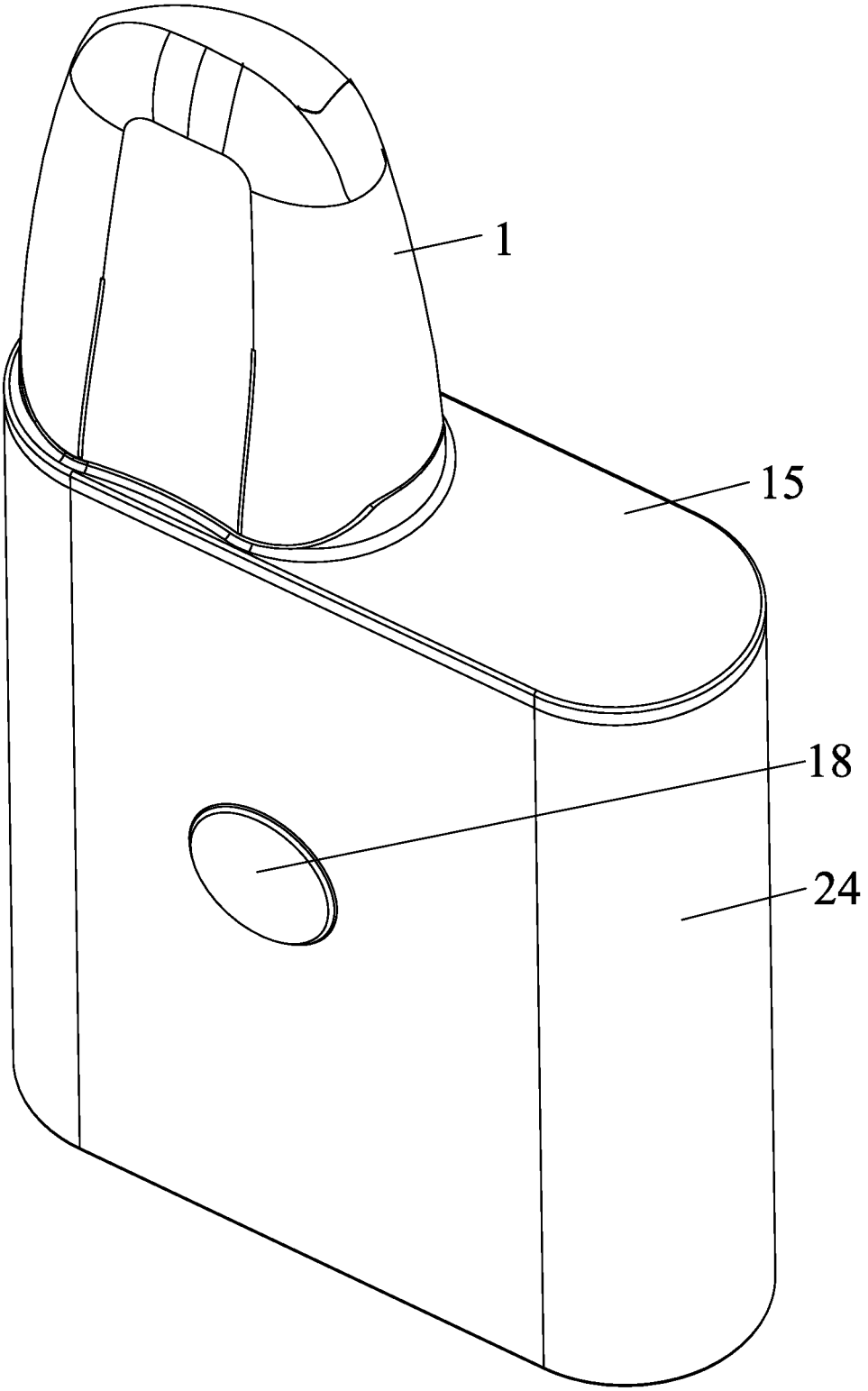
FIG. 4 is a schematic diagram of an electronic cigarette according to one embodiment of the disclosure.
Figure 5:
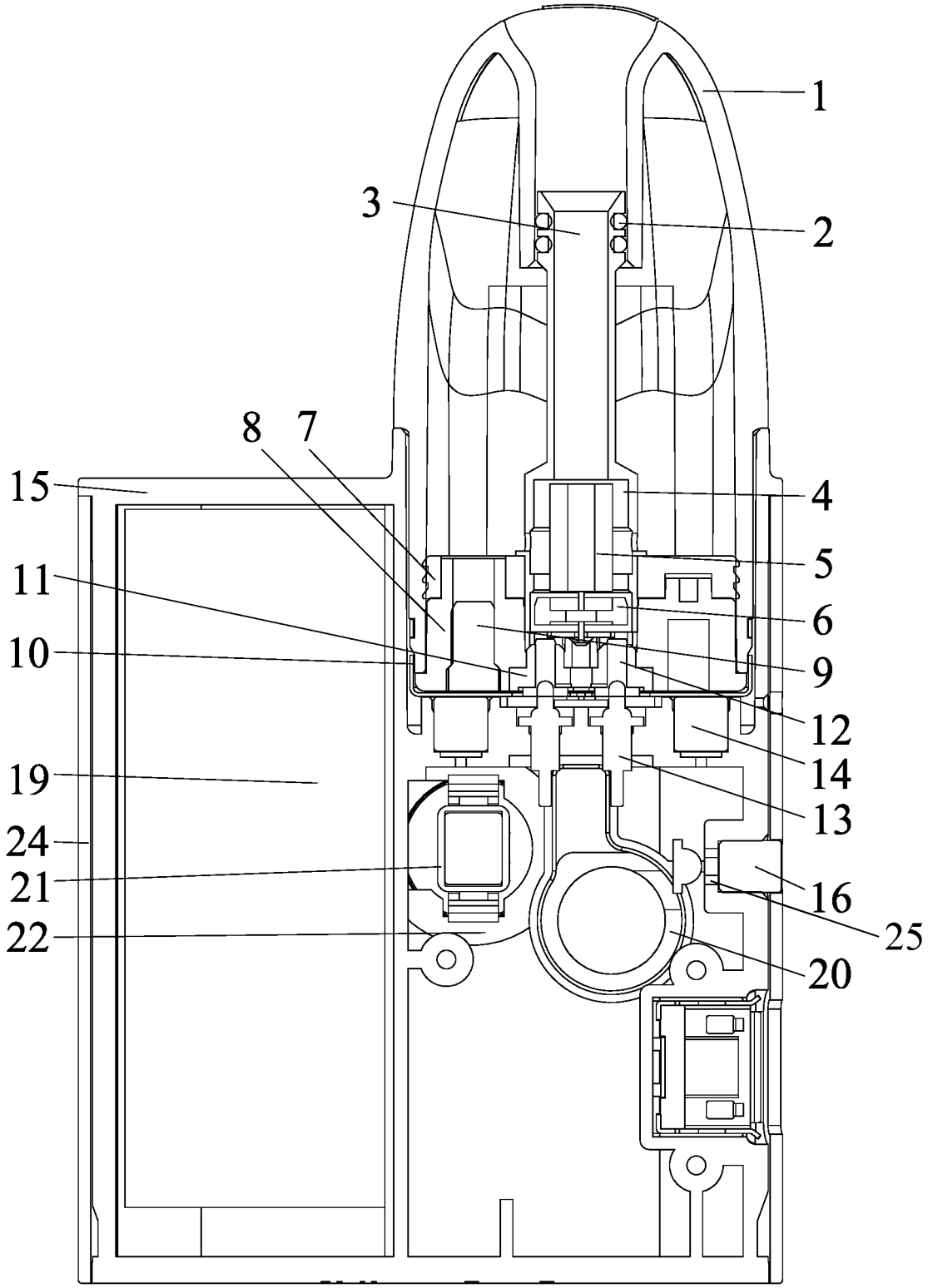
FIG. 5 is a sectional view of an electronic cigarette according to one embodiment of the disclosure.

As shown in FIGS. 1-5, an electronic cigarette comprises an atomization assembly A and a battery assembly B. The atomization assembly A is disposed on the battery assembly B. The atomization assembly comprises a magnet and the battery assembly comprises a stainless iron adsorbing on the magnet.

The atomization assembly A comprises an e-liquid tank 1, a first seal ring 2, a limit cover 3, a second seal ring 4, a ceramic core 5, a piece of cotton 6, a seal gasket 7, a base cover 8, a seal plug 9, a stainless iron 10, a silica pad 11, and a joint 12. The first seal ring 2 is disposed on the top of the limit cover 3. The second seal ring 4 is disposed on the ceramic core 5. The piece of cotton 6 is disposed on the bottom of the ceramic core 5. The second seal ring 4, the ceramic core 5, and the piece of cotton 6 are disposed in the limit cover 3. The seal gasket 7 is wrapped around the base cover 8. The limit cover 3 is disposed on the seal gasket 7. The joint 12 is inserted in the silica pad 11. The seal plug 9 is inserted in the base cover 8. The base cover 8 is disposed in the e-liquid tank 1, and the stainless iron 10 is wrapped around the base cover and is disposed on the bottom of the e-liquid tank 1.

The battery assembly B comprises a spring contact 13, a magnet 14, a support frame 15, a lampshell 16, a cap 17, a button 18, a battery 19, a silica ring 20, a silica gasket 21, a control panel 22, a bolt 23, and a housing 24. The spring contact 13 and the magnet 14 are disposed on the top of the support frame 15 for electric conduction and connection to the atomization assembly. The battery 19 comprises an output end connected to an input end of the control panel 22 to supply power to the control panel 22. The silica ring 20 is disposed on a pneumatic switch on the control panel 22. The silica gasket 21 is disposed on a power button 221 of the control panel 22 to protect the power button 221 and exhibits insulation function. The cap 17 is disposed on the silica gasket 21 to ensure the stress balance when the power button 221 is pressed. The button 18 is disposed on the cap 17. The control panel 22 is disposed in the support frame 15 and is fixed by the bolt 23. The support frame 15 is disposed in the housing 24. The lampshell 16 passes through the openings of the housing 24 and the support frame 15 and is fixed on an LED light 25 to gather and transmit the light out of the battery.

The color of the LED light 25 is controlled by the control panel 22; when the battery is fully charged, the LED light 25 turns green; when the battery is half charged, the LED light 25 turns blue; when the battery is out of power, the LED light 25 turns red. The lampshell 16 comprises polycarbonate and is disposed outside the LED light 25.

It will be obvious to those skilled in the art that changes and modifications may be made, and therefore, the aim in the appended claims is to cover all such changes and modifications.

What is claimed is:

1. An electronic cigarette, comprising: an atomization assembly and a battery assembly;

wherein:

the battery assembly comprises a silica gasket, a cap, a LED light, and a control panel having a power button;

the silica gasket is disposed on the power button;

the silica gasket is configured to protect and insulate the power button;

the cap is disposed on the silica gasket;

the cap is configured to ensure the stress balance around the power button when the power button is pressed; and the control panel is configured to control the LED light to display a color to indicate a battery level of the battery assembly.

2. The electronic cigarette of claim 1, wherein the color of the LED light is controlled by the control panel; when the battery is fully charged, the LED light turns green; when the battery is half charged, the LED light turns blue; when the battery is out of power, the LED light turns red.

3. The electronic cigarette of claim 1, wherein the battery assembly further comprises a lampshell and a battery; the battery is configured to supply power to the control panel; the lampshell is disposed outside the LED light.

4. The electronic cigarette of claim 2, wherein the battery assembly further comprises a lampshell and a battery; the battery is configured to supply power to the control panel; the lampshell is disposed outside the LED light.

5. The electronic cigarette of claim 3, wherein the lampshell comprises polycarbonate.

6. The electronic cigarette of claim 4, wherein the lampshell comprises polycarbonate.

7. The electronic cigarette of claim 1, wherein the atomization assembly is disposed on the battery assembly; and the atomization assembly comprises a magnet and the battery assembly comprises a stainless iron adsorbing on the magnet.

8. The electronic cigarette of claim 1, wherein the battery assembly further comprises a spring contact, and the spring contact is configured to provide electrical conduction and connection between the battery assembly and the atomization assembly.

* * * * *